US009181761B2

(12) United States Patent
Hafernik et al.

(10) Patent No.: US 9,181,761 B2
(45) Date of Patent: Nov. 10, 2015

(54) RISER TENSIONING SYSTEM

(75) Inventors: Steven Hafernik, Houston, TX (US); Fife Ellis, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 489 days.

(21) Appl. No.: 14/402,215

(22) PCT Filed: Apr. 19, 2011

(86) PCT No.: PCT/US2011/033054

§ 371 (c)(1), (2), (4) Date: Nov. 19, 2014

(87) PCT Pub. No.: WO2011/133552

PCT Pub. Date: Oct. 27, 2011

(65) Prior Publication Data

US 2015/0136412 A1 May 21, 2015

Related U.S. Application Data

(60) Provisional application No. 61/325,998, filed on Apr. 20, 2010.

(51) Int. Cl.

| | |
|---|---|
| ***E21B 17/01*** | (2006.01) |
| ***E21B 19/00*** | (2006.01) |
| ***B63B 35/44*** | (2006.01) |

(52) U.S. Cl.

CPC ..... *E21B 19/006* (2013.01); *B63B 35/4413* (2013.01); *E21B 17/012* (2013.01); *E21B 19/002* (2013.01); *B63B 2035/448* (2013.01)

(58) Field of Classification Search

CPC ..... E21B 17/01; E21B 19/004; E21B 19/006

USPC ..... 166/360, 355, 367; 405/224.2, 224.4

See application file for complete search history.

(56) References Cited

U.S. PATENT DOCUMENTS

| | | | | |
|---|---|---|---|---|
| 4,095,649 | A | 6/1978 | Chateau et al. | |
| 4,215,950 | A * | 8/1980 | Stevenson | 405/168.4 |
| 4,362,438 | A * | 12/1982 | Spink | 405/195.1 |
| 5,479,990 | A | 1/1996 | Peppel | |
| 5,551,803 | A * | 9/1996 | Pallini et al. | 405/223.1 |
| 6,260,625 | B1 * | 7/2001 | Phan et al. | 166/355 |

(Continued)

FOREIGN PATENT DOCUMENTS

WO WO 2009102216 A2 * 8/2009 ..... E21B 19/00

OTHER PUBLICATIONS

International Search Report and Written Opinion issued in related PCT Application No. PCT/US2011/033057 mailed Jul. 1, 2011, 9 pages.

(Continued)

*Primary Examiner* — Matthew Buck
(74) *Attorney, Agent, or Firm* — Baker Botts L.L.P.

(57) ABSTRACT

The riser tensioning system (10) includes a tensioning ring (18) for secured engagement with the riser and plurality of hydraulic cylinders (12) extending between the tensioning ring and a floating platform. A gimbal mechanism (42) acts between the platform and the riser to allow the riser axis to tilt relative to the floating platform. One or more elongate torque transfer members (38) extend between the tensioning ring and the gimbal mechanism and allow axial movement of the tensioning ring and the riser with respect to the floating platform.

17 Claims, 8 Drawing Sheets

(56) References Cited

U.S. PATENT DOCUMENTS

| | | | | |
|---|---|---|---|---|
| 6,431,284 | B1 * | 8/2002 | Finn et al. | 166/350 |
| 6,648,074 | B2 * | 11/2003 | Finn et al. | 166/350 |
| 7,690,434 | B2 * | 4/2010 | Baross et al. | 166/354 |
| 2005/0147473 | A1 * | 7/2005 | Pallini et al. | 405/224.4 |
| 2006/0280560 | A1 * | 12/2006 | Ellis et al. | 405/223.1 |
| 2008/0304916 | A1 * | 12/2008 | Crotwell et al. | 405/224.2 |
| 2009/0145611 | A1 * | 6/2009 | Pallini et al. | 166/355 |
| 2010/0054863 | A1 | 3/2010 | Will | |

OTHER PUBLICATIONS

International Preliminary Report on Patentability issued in related PCT Application No. PCT/US2011/033057 mailed Apr. 30, 2012, 29 pages.

* cited by examiner

RISER TENSIONING SYSTEM

CROSS-REFERENCE TO RELATED APPLICATIONS

This application is a U.S. National Stage Application of International Application No. PCT/US2011/033054 filed Apr. 19, 2011 and claims the priority of U.S. Provisional Application No. 61/235,998 filed on Apr. 20, 2010, the disclosures of which are incorporated herein by reference for all purposes in their entirety.

FIELD OF THE INVENTION

The present invention relates to offshore oil and gas floating platforms, and to a system for tensioning a riser extending from a subsea wellhead to a floating platform. The system includes a plurality of hydraulic cylinders which control the vertical position of the riser and a mechanism to transfer riser torque to the hull.

BACKGROUND OF THE INVENTION

Various types of tensioners have been devised for use in the oil and gas industry. U.S. Pat. No. 4,039,177 discloses a compensation mechanism with a passive damped pneumatic-hydraulic spring system. U.S. Pat. No. 4,799,827 discloses a modular riser tensioner, and U.S. Pat. No. 5,160,219 discloses a variable spring rate riser tensioner. U.S. Pat. No. 4,617,998 discloses a riser with a braking system. Other patents of interest includes U.S. Pat. Nos. 3,970,292, 4,004,532, 4,072,190, 4,215,950, 4,616,707, 4,721,053, 4,799,827, 4,828,230, 4,883,387, 4,883,388, 4,892,444, 5,020,942, 5,252,004, 5,283,552, 5,244,313, 5,551,803, 5,671,812, 5,846,028, 5,944,111, 6,045,296, 6,585,455, 7,112,011, 7,328,741, 7,329,070, and 7,632,044.

U.S. Pat. No. 4,787,778 discloses a riser tensioning system with three tensioners pivotally secured to a hollow surface of the production platform and to a tensioner ring. Publications of interest include U.S. 2005/0147473, U.S. 2006/0108121, U.S. 2006/0280560, U.S. 2007/0056739, U.S. 2007/0196182, U.S. 2008/0205992, and U.S. 2009/0145611.

The disadvantages of the prior art are overcome by the present invention, an improved riser tensioning system is hereinafter disclosed.

SUMMARY OF THE INVENTION

A riser tensioning system includes a tensioning ring 18 for secured engagement with the riser, a plurality of hydraulic cylinders 12 each extending between the tensioning ring and a folding platform, and a gimbal mechanism below the tensioning ring and acting between the platform and the riser to allow the riser axis to tilt relative to the platform. One or more torque transfer members or supports extend between the tensioning ring and the gimbal mechanism and allow axial movement of the tensioning ring and the riser with respect to the floating platform.

These and further features and advantages of the present invention will become apparent from the following detailed description, wherein reference is made to the figures in the accompanying drawings.

DETAILED DESCRIPTION OF PREFERRED EMBODIMENTS

Figure 1:
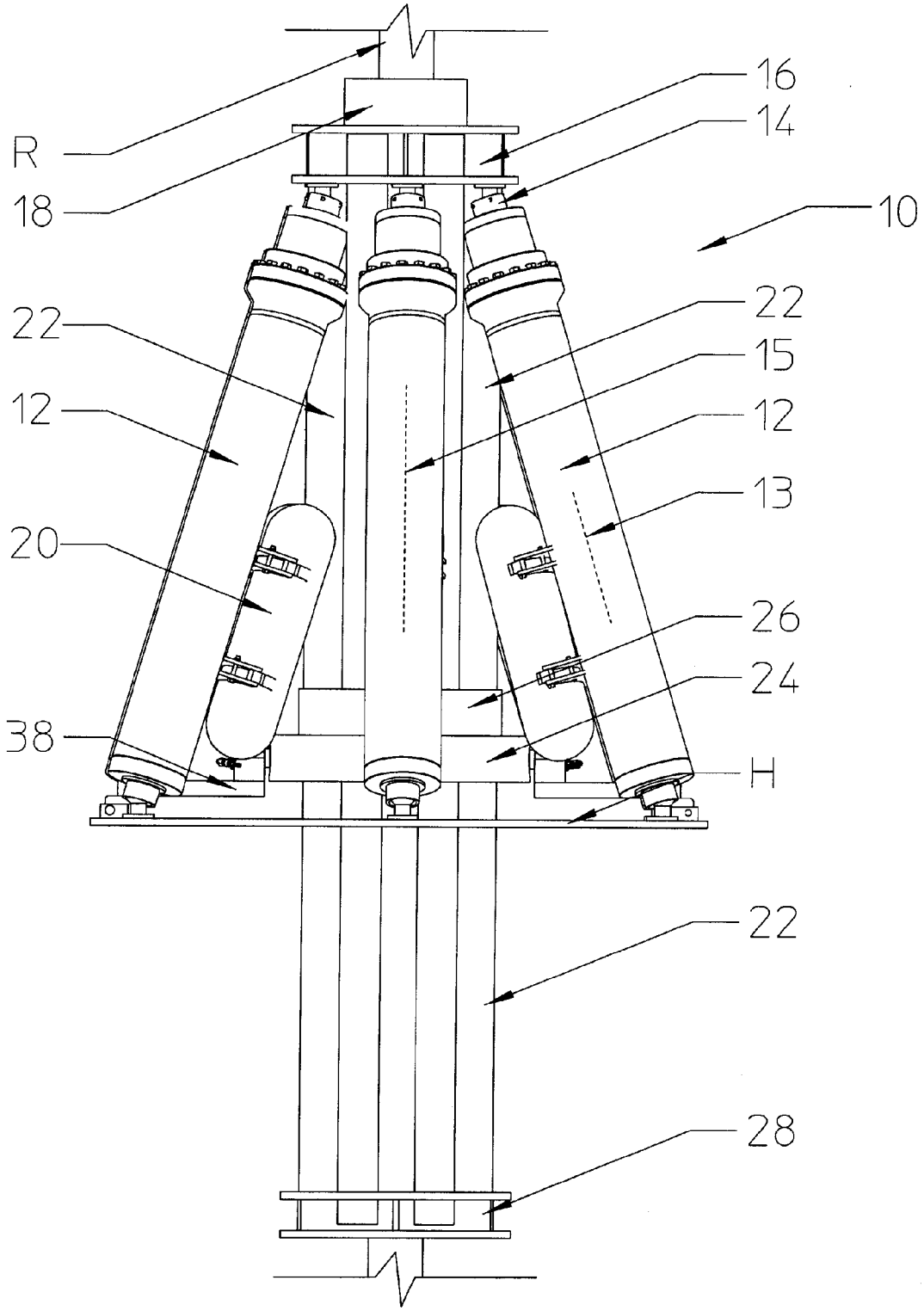
FIG. 1 illustrates a riser tensioning system according to one embodiment of the invention and a portion of a hull.

FIG. 1 illustrates one embodiment of a tensioning system 10 for tensioning a riser R extending from an offshore platform to a subsea wellhead. The tensioning system is conveniently supported on a portion of the hull H of the offshore platform.

The tensioning system 10 includes a plurality of circumferentially spaced cylinders 12 each having a cylindrical axis 13 inclined relative to the system central axis 15. The lower end of each cylinder may be secured to the hull H, as discussed subsequently, while the rod end 14 is interconnected with the tensioning ring 18, which is conventionally in secured engagement with the riser R. More particularly, the rod end 14 of each cylinder 12 is connected to the load frame 16, which in turn is secured to the tensioning ring 18. One or more pressurized fluid hydraulic cylinders may be provided for extending and retracting each hydraulic cylinder 12. Those skilled in the art will appreciate that the tensioning system as shown in FIG. 1 has its cylinders 12 in a substantially retracted position. The cylinders extend so that the tensioning ring 18 and the riser move upward as a sub-assembly during cylinder extension.

Figure 2:
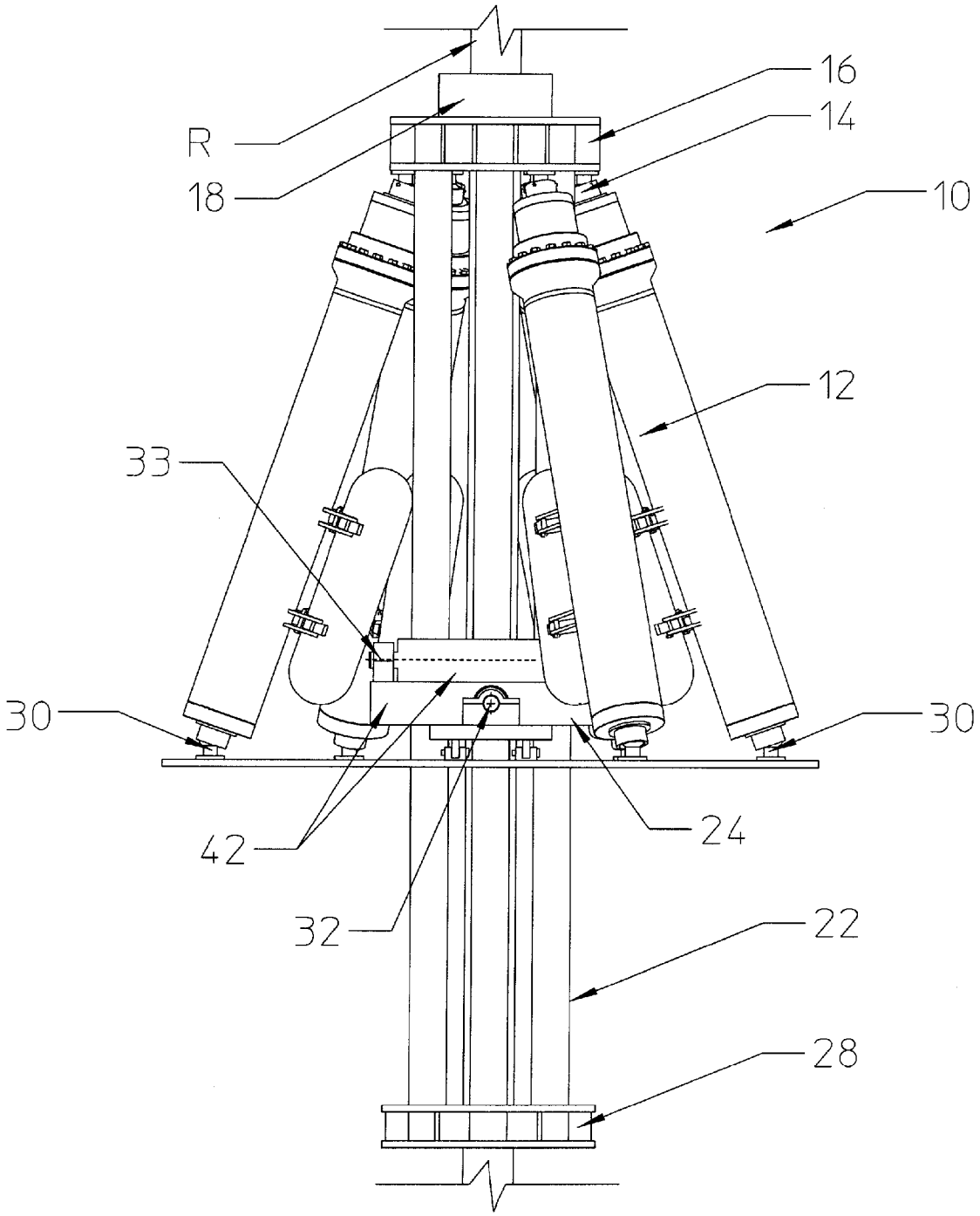
FIG. 2 is a side view of the system shown in FIG. 1.
Figure 4:
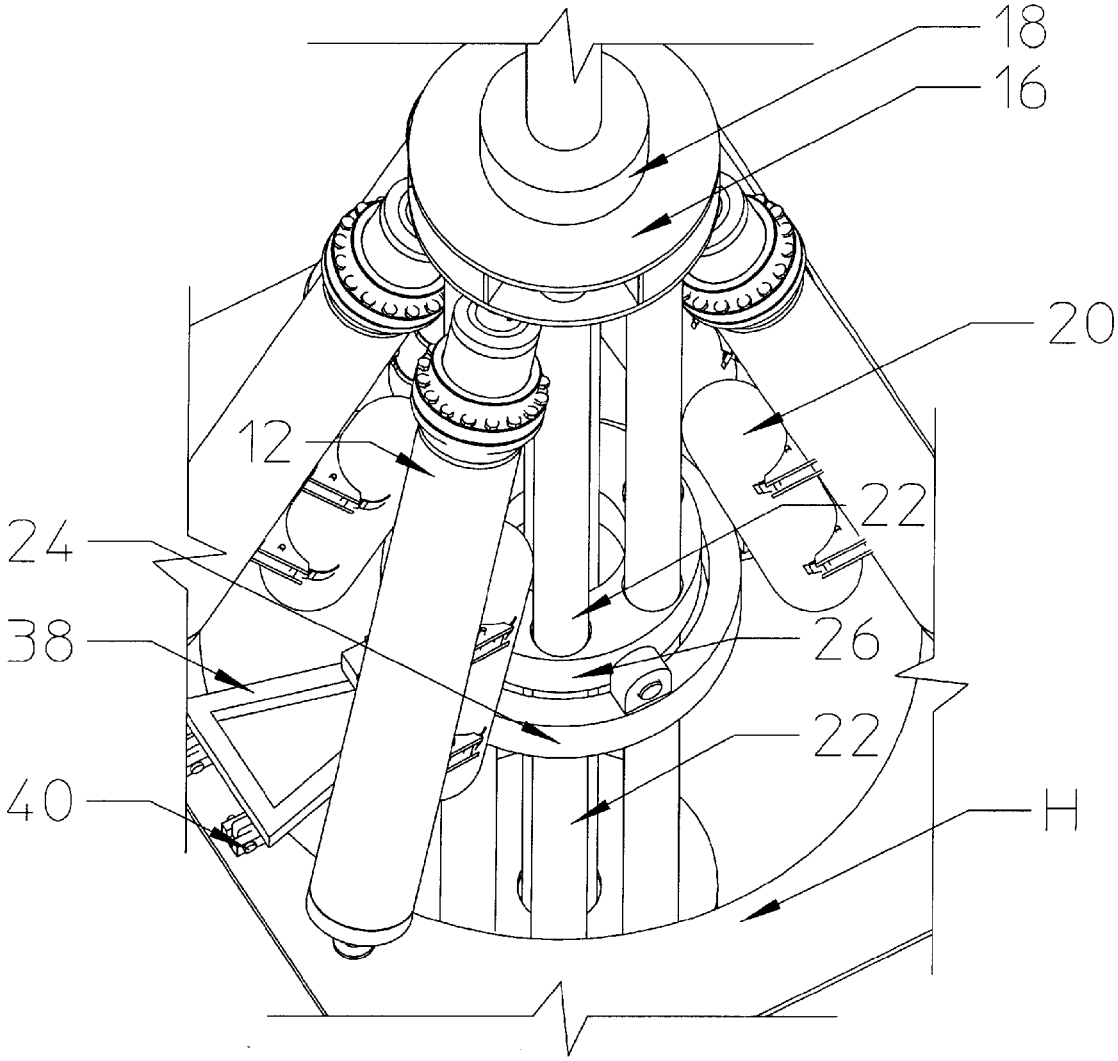
FIG. 4 is an isometric view of a portion of the system shown in FIG. 1.

As shown in FIGS. 1, 2 and 4, a plurality of circumferentially spaced rods 22 extend between the load frame 16 and a lower support frame 28. Each of the rods thus passes through an opening in an inner guide ring 26. Inner ring 26 and outer ring 24 together form a gimbal, with the axis 32 of the gimbal outer ring 24 being perpendicular to the axis 33 (see FIG. 2) of the gimbal inner ring 32. The gimbal 42 thus comprises two rings mounted together on perpendicular axes with supports 38 extending radially outward to pivots 40, as shown in FIG. 4, which are attached to the hull H. Each support 38 preferably rotates about pivots 40, so it may be pivoted out of the way and larger objects passed through the opening in the hull prior to positioning of the cylinders as shown in FIG. 1. When positioned as shown in FIGS. 1 and 4, the supports 38 transfer torque from the gimbal mechanisms to the hull, and transfer lateral loads form the gimbal to the hull, thereby centralizing the riser, and thus serve as torque transfer members.

FIG. 2 depicts more clearly the lower end of four of the cylinders 30 each supported on the hull H and the support rods 22. In the FIGS. 1 and 2 embodiment, six cylinders 12 are equally spaced about the riser, and six support rods are used to transfer torque from the riser to the hull. More or less cylinders and/or support rods may be suitable for some applications. Each cylinder 12 is pivotally mounted to the hull by lower pivot mechanism 30.

Figure 3:
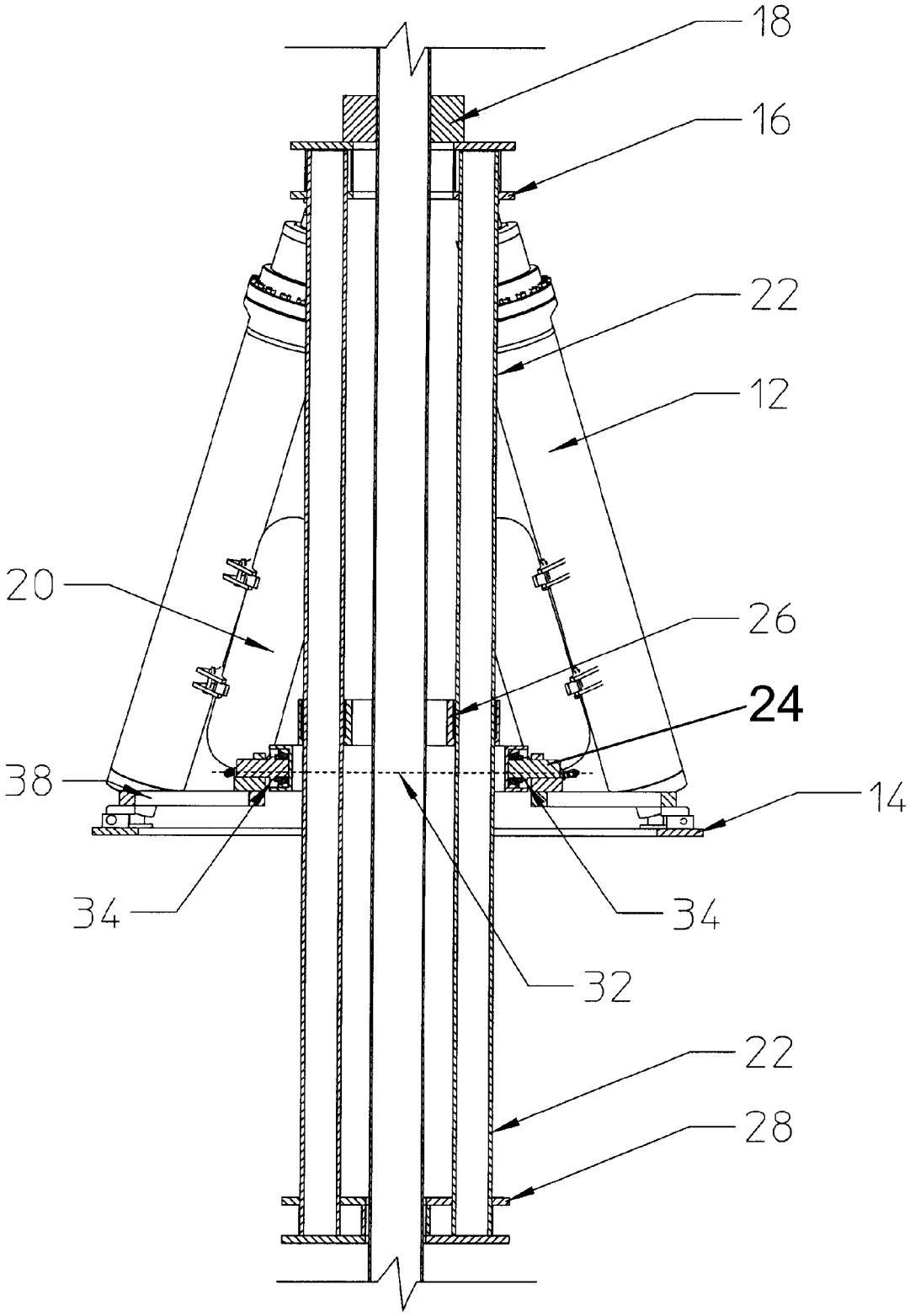
FIG. 3 is another side view, partially in cross-section, of the system shown in FIG. 1.

FIG. 3 is a cross-sectional view of the system shown in FIG. 1, and illustrates the circumferentially spaced rods 22 passing through the inner gimbal ring 26, which includes wear members to facilitate smooth raising and lowering of the rods 22 with respect to the inner ring. FIG. 3 also illustrates a trunion 34 which rotatably mounts the outer gimbal bearing about axis 32. The trunion ends of the outer gimbal ring are thus supported on the structure 38. The trunion for the inner gimbal bearing is perpendicular to axis 32, but is not visible in this section view.

FIG. 4 is a top pictorial view of a system shown in FIG. 1, and more particularly illustrates one of the rods 22 passing through the inner gimbal ring 26 and extending downward below the outer gimbal ring 24 to the lower support frame 28. The rods 22 may be solid in cross-section, but preferably are tubular to reduce weight.

Figure 5:
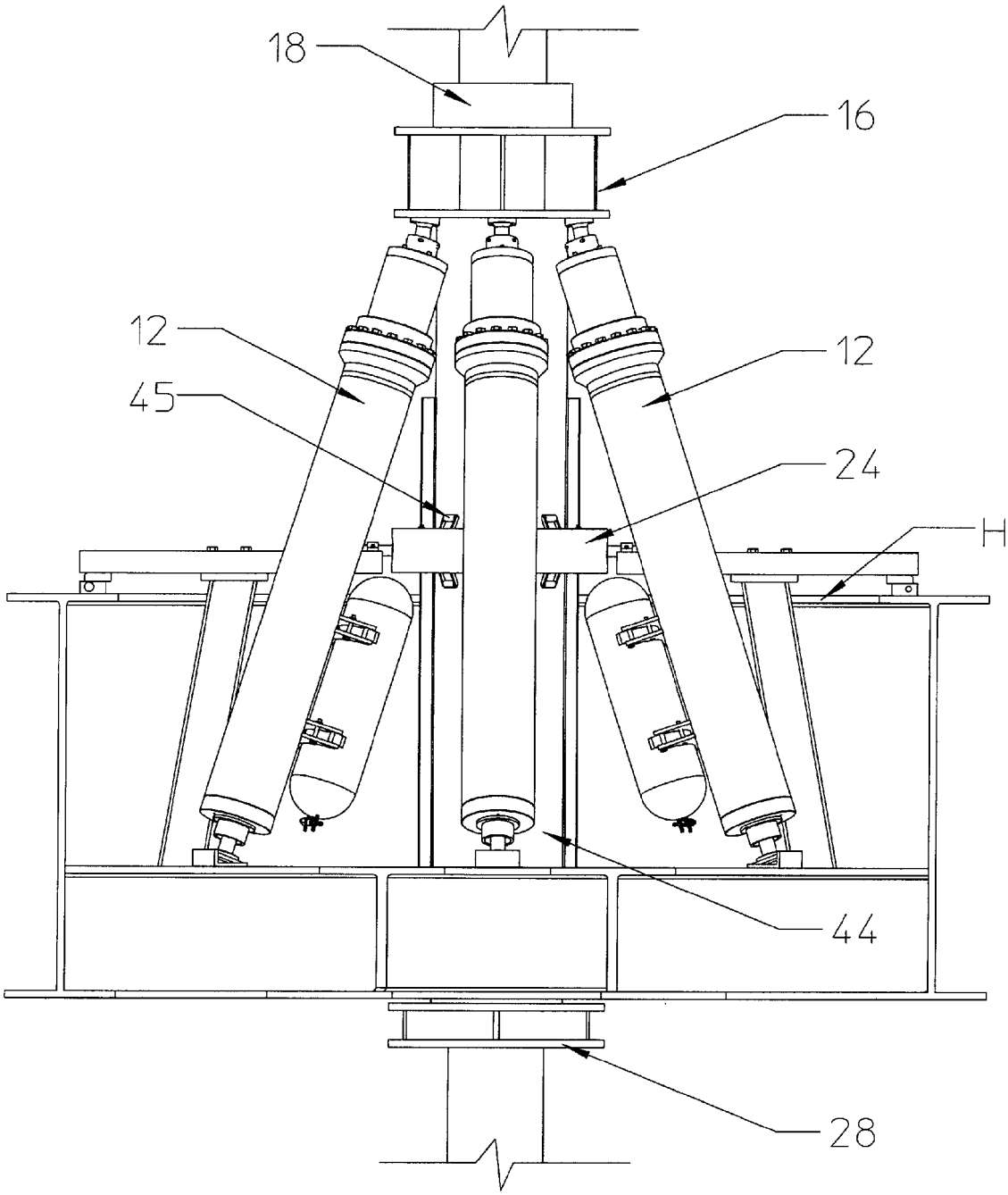
FIG. 5 is a side view of an alternative riser tensioning system.

FIG. 5 is a pictorial view of an alternative system 10, including a tensioning ring 18, cylinders 12 and gimbal mechanism 42 similar to those components discussed above. A gimbal mechanism with perpendicular axes may be provided for tilting relative to vertical in any direction within the X-Y plane, similar to the embodiment shown in FIG. 1. For this embodiment, the plurality of circumferentially spaced rods 22 are eliminated and replaced with a single torque transfer tubular 44 which extends from the load frame 16 to the lower support frame while passing through the gimbal mechanism 42. More particularly, the tubular 44 and the gimbal mechanism are rotationally locked together by engaging stop surfaces while axially extending slots allow the tensioning ring 18 to move upward relative to gimbal mechanism 42 when the cylinders 12 are extended. The tubular 44 serves the same purpose as the rods 22. For both embodiments, the gimbal is desirably stationary and does not move vertically with the tensioning ring 18 and the riser, thereby obviating the need for vertical rails to transfer torque to the platform. For this embodiment, the axis of the inner gimbal ring is of the same elevation as the axis of the outer gimbal ring. The gimbal arrangement as shown in FIG. 2 wherein the inner ring axis is perpendicular to and spaced from the outer ring may be preferred to facilitate a robust design. In the FIG. 5 embodiment, a lower support frame 28 is raised above the lower end of the depicted hull H it when the cylinders 12 are extended.

Figure 6:
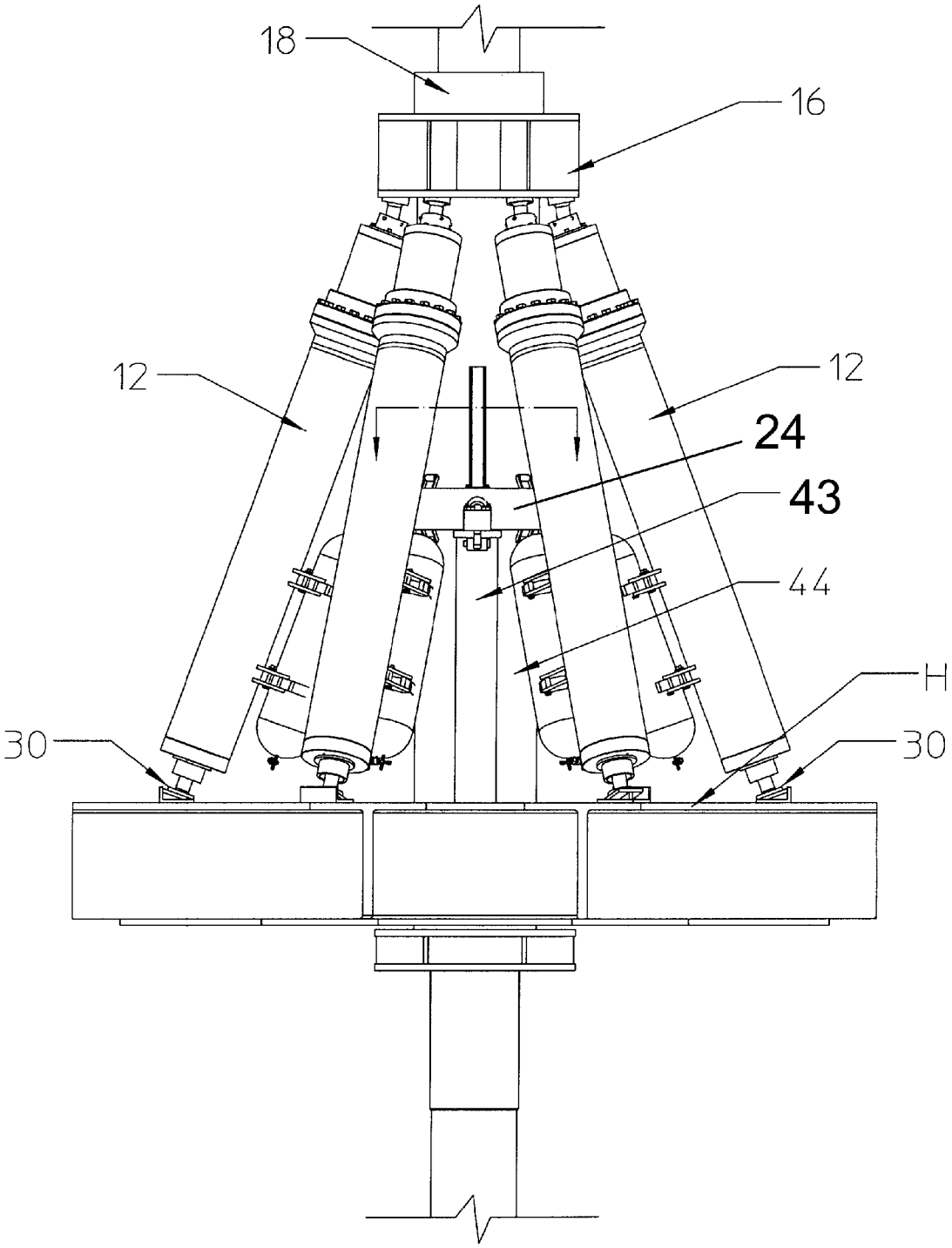
FIG. 6 is another side view of the system shown in FIG. 5.

Referring now to FIG. 6, the tubular 44 includes a radially outward projecting key 43 which fits within a corresponding elongate slot in the inner gimbal ring 26, which as previously noted is rotationally connected to the hull. Torque is thus transferred from the tubular 44 to the hull through the key and slot mechanism, which allows the axial position of the tubular 44 and the tensioning ring 18 to move it vertically with respect to the hull when the cylinders 12 are extended. The gimbal mechanism 42 is connected to the hull, as shown more clearly in FIG. 8. Elevating the gimbal mechanism as shown in FIG. 5 with respect to the lower end of the cylinders 12 desirably reduces the moment arm between the load frame 16 and the lower support frame 28, although a lower gimbal position as shown in FIGS. 1-4 is preferred in some applications due to available space.

Figure 7:
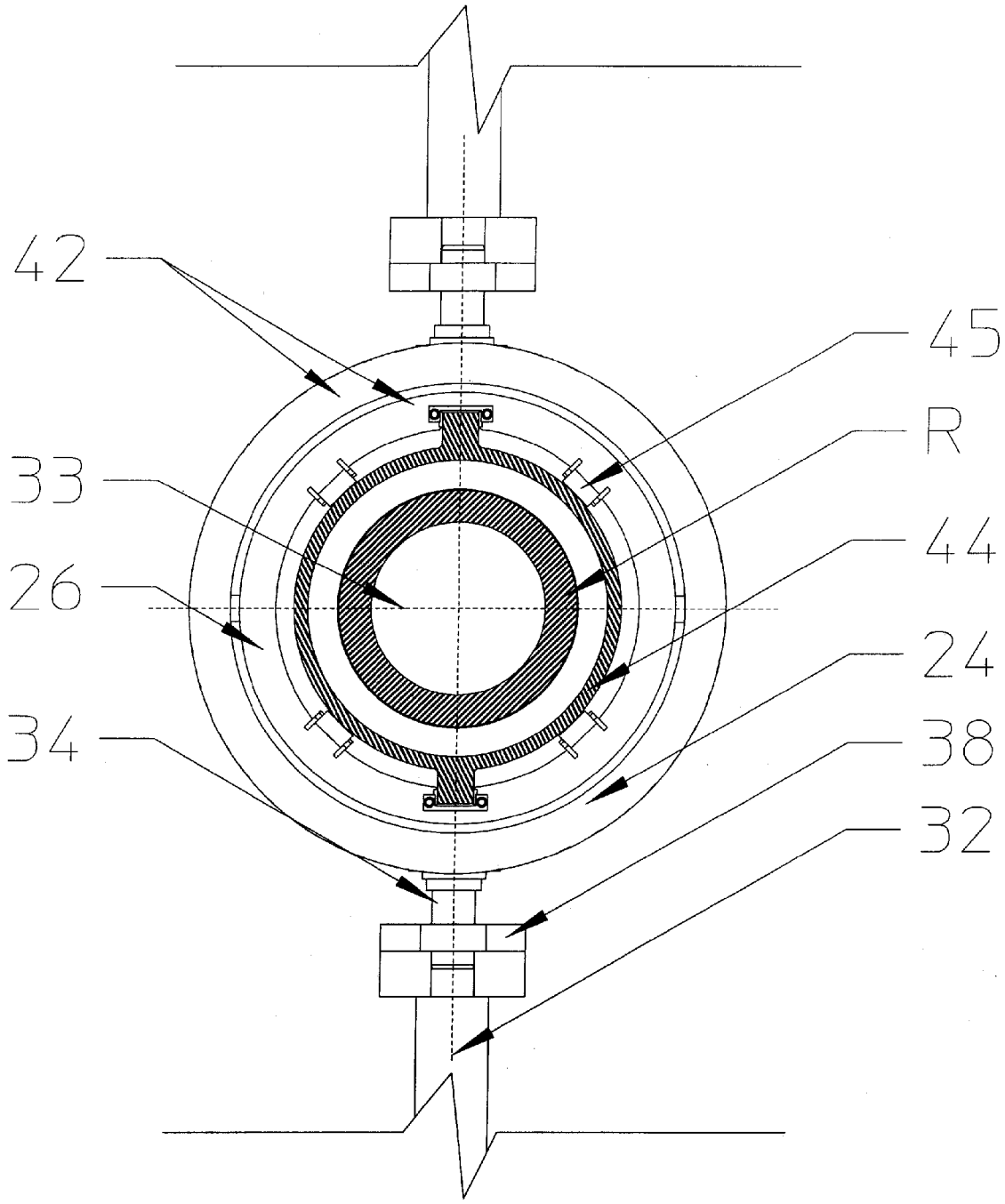
FIG. 7 is a cross-sectional view through the conductor shown in FIG. 6.

FIG. 7 depicts in a cross-section the riser R in the center of the tubular 44, with the key 43 fitting within a keyway within the gimbal mechanism 42. The radially outermost components 38 as shown in FIG. 7 are part of the supporting structure for the gimbals. Rollers 45 attached to the inner gimbal ring serve to keep the tubular 44 and thus the risers centralized within the gimbal.

Figure 8:
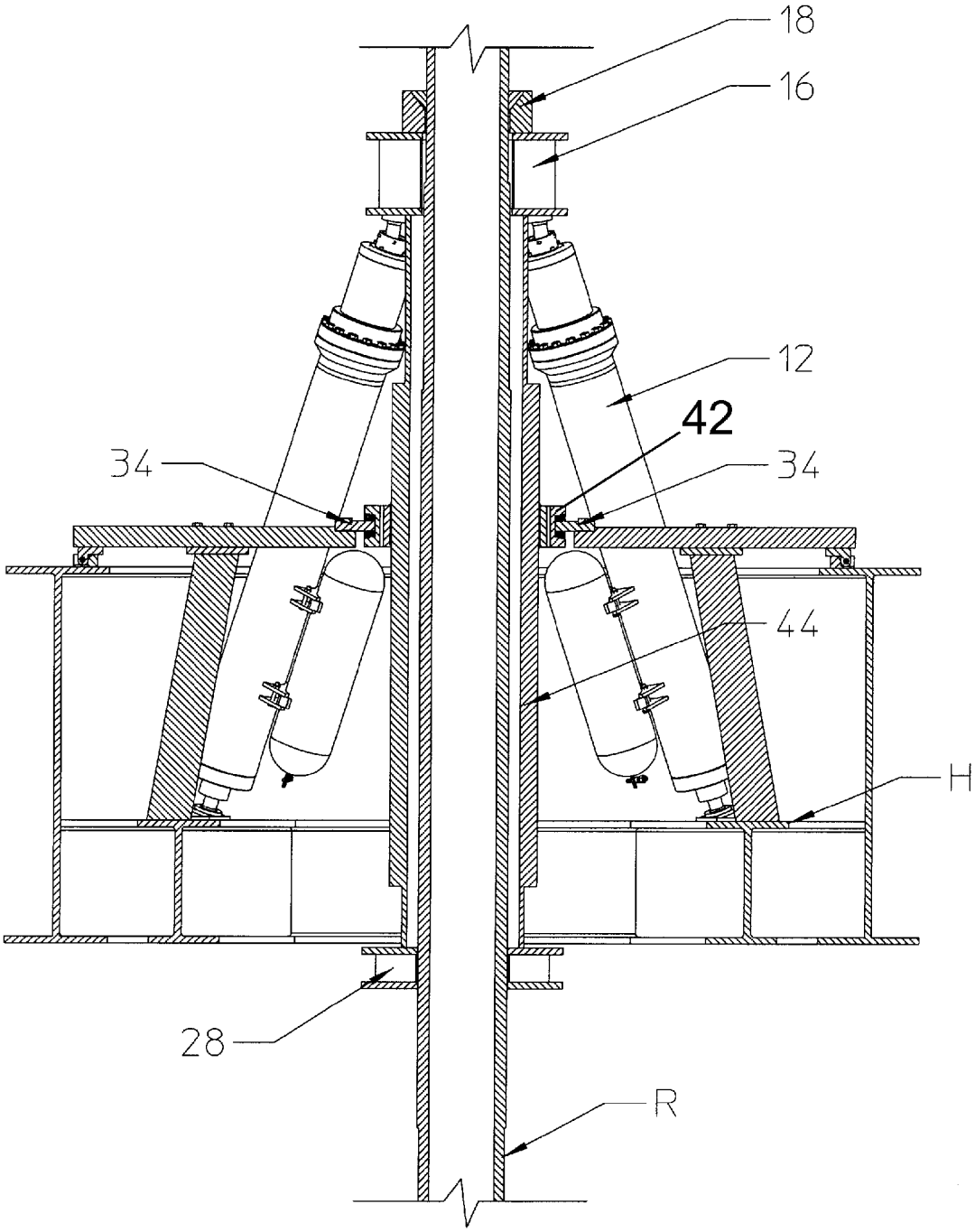
FIG. 8 is another view, partially in cross-section, of the riser tensioning system shown in FIG. 5.

FIG. 8 depicts in cross-section the FIG. 5 embodiment. A pair of trunions 34 allow the axis of both the hull and the riser to tilt slightly, and to also tilt about an axis perpendicular to the axis shown in FIG. 8. With the gimbal mechanism, riser tilting in any direction within 360° is thus permissible, while the torque on the riser is reliably transferred to the hull.

The system as disclosed herein uses gimbals for an angular offset between the riser and the platform, and prevents torsional loads from being directed through the hydraulic cylinders 12 while keeping the riser centralized within the wellbay. The hydraulic cylinders are preferably mounted at an angle relative to the riser as shown in the attached figures, so that the upper tensioning ring may be smaller in diameter to reduce the bending moment and allow the tensioning ring to pass through a conventional rotary table. Large diameter strakes or tie-back connectors may be passed through the system by simply detaching the upper end of the cylinders and pivoting each cylinder out of the way. Angled cylinders are inherently less stable, which increases the benefits of accommodating both the torsional loads and the lateral loads between the riser and the hull.

The use of a plurality of cylindrical rods effectively transmits the torsional loads from the tensioning ring through the gimbal and to the hull. These rods also transfer the lateral loads from the riser to the gimbal and then to the structure, and resist bending loads which could be significant if one of the hydraulic cylinders should fail. The torque transfer rods provide support and stabilization to the cylinder arrangement while allowing the cylinders to move with respect to the platform. In an alternative embodiment, a single support tubular is used surrounding the riser for transmitting torsional and lateral loads through the gimbal and to the hull while allowing axial movement between the riser and the gimbal.

Load frame 16 serves the purpose of mechanically connecting the rod end of each hydraulic cylinder with the tensioning ring, while also allowing for adjustment so that all the hydraulic cylinders, when activated, uniformly move the tensioning ring. The torque transfer tubular 44, serves the same purpose as the rods 22.

Although specific embodiments of the invention have been described herein in some detail, this has been done solely for the purposes of explaining the various aspects of the invention, and is not intended to limit the scope of the invention as defined in the claims which follow. Those skilled in the art will understand that the embodiment shown and described is exemplary, and various other substitutions, alterations and modifications, including but not limited to those design alternatives specifically discussed herein, may be made in the practice of the invention without departing from its scope.

What is claimed is:

1. A riser tensioning system for tensioning a riser extending from a subsea wellhead to a floating platform, the riser tensioning system comprising:

a tensioning ring for secured engagement with the riser:

a plurality of hydraulic cylinders each extending between the tensioning ring and the floating platform;

a gimbal mechanism below the tensioning ring and acting between the platform and the riser and allowing the riser axis to tilt relative to the floating platform, wherein the gimbal mechanism comprises an inner ring having a first axis and an outer ring having a second axis, wherein the first axis is perpendicular to the second axis, wherein the gimbal mechanism accommodates tilting of the riser in any direction; and one or more elongate torque transfer members extending between the tensioning ring and gimbal mechanism, the one or more torque transfer members transferring riser torque from the tensioning ring through the gimbal mechanism and to the floating platform while allowing axial movement of the tensioning ring and the riser with respect to the floating platform.

2. A riser tensioning system as defined in claim 1, wherein each of the plurality of hydraulic cylinders has a cylinder axis inclined with respect to a central riser axis, such that a lower end of each cylinder is spaced radially from the riser more than an upper end of each cylinder.

3. A riser tensioning system as defined in claim 1, wherein the one or more torque transfer members includes a plurality of circumferentially spaced supported rods each extending through the gimbal mechanism to a lower support frame for transferring torque from the tensioning ring to the floating platform.

4. A riser tensioning system as defined in claim 3, further comprising:

a guide member for guiding movement of each of the one or more torque transfer members when the cylinders are extended or retracted.

5. A riser tensioning system as defined in claim 1, wherein the one or more torque transfer members comprise a tubular surrounding the riser and interconnecting the tensioning ring and a lower support frame, each of the tubular and the floating platform including a stop for mated engagement to transfer torque from the tensioning ring to the floating platform.

6. A riser tensioning system as defined in claim 5, wherein one of the tubular and the gimbal mechanism is provided with an elongate key, and the other of the tubular and the gimbal mechanism is provided with an elongate slot for accommodating the key, thereby providing the stop to transfer torque from the tubular to the floating platform.

7. A riser tensioning system for tensioning a riser extending from a subsea wellhead to a floating platform, the riser tensioning system comprising:

a tensioning ring for secured engagement with the riser;

a plurality of hydraulic cylinders each having an inclined cylinder axis with respect to a central riser axis, extending between the tensioning ring and the floating platform, such that a lower end of each cylinder is spaced radially from the riser more than an upper end of each cylinder;

a gimbal mechanism below the tensioning ring and acting between the platform and the riser and allowing the riser axis to tilt relative to the floating platform, wherein the gimbal mechanism comprises an inner ring having a first axis and an outer ring having a second axis, wherein the first axis is perpendicular to the second axis, wherein the gimbal mechanism accommodates tilting of the riser in any direction; and one or more elongate torque transfer members extending between the tensioning ring and gimbal mechanism, the one or more torque transfer members transferring riser torque from the tensioning ring through the gimbal mechanism and to the floating platform while allowing axial movement of the tensioning ring and the riser with respect to the floating platform.

8. A riser tensioning system as defined in claim 7, wherein the one or more torque transfer members includes a plurality of circumferentially spaced supported rods each extending through the gimbal mechanism to a lower support frame for transferring torque from the tensioning ring to the floating platform.

9. A riser tensioning system as defined in claim 8, further comprising:

a guide member for guiding movement of each of the one or more torque transfer members when the cylinders are extended or retracted.

10. A riser tensioning system as defined in claim 7, wherein the one or more torque transfer members comprise a tubular surrounding the riser and interconnecting the tensioning ring and a lower support frame, each of the tubular and the floating platform including a stop for mated engagement to transfer torque from the tensioning ring to the floating platform.

11. A riser tensioning system as defined in claim 10, wherein one of the tubular and the gimbal mechanism is provided with an elongate key, and the other of the tubular and the gimbal mechanism is provided with an elongate slot for accommodating the key, thereby providing the stop to transfer torque from the tubular to the floating platform.

12. A method of tensioning a riser extending from a subsea wellhead to a floating platform, the method comprising:

securing a tensioning ring with the riser:

providing a plurality of hydraulic cylinders each extending between the tensioning ring and the floating platform;

positioning a gimbal mechanism below the tensioning ring and acting between the platform and the riser and allowing the riser axis to tilt relative to the floating platform, wherein the gimbal mechanism comprises an inner ring having a first axis and an outer ring having a second axis, wherein the first axis is perpendicular to the second axis, wherein the gimbal mechanism accommodates tilting of the riser in any direction; and providing one or more elongate torque transfer members extending between the tensioning ring and gimbal mechanism, the one or more torque transfer members transferring riser torque from the tensioning ring through the gimbal mechanism and to the floating platform while allowing axial movement of the tensioning ring and the riser with respect to the floating platform.

13. A method as defined in claim 12, wherein each of the plurality of hydraulic cylinders has a cylinder axis inclined with respect to a central riser axis, such that a lower end of each cylinder is spaced radially from the riser more than an upper end of each cylinder.

14. A method as defined in claim 12, wherein the one or more torque transfer members includes a plurality of circumferentially spaced supported rods each extending through the gimbal mechanism to a lower support frame for transferring torque from the tensioning ring to the floating platform.

15. A method as defined in claim 14, further comprising:

guiding movement of each of the one or more torque transfer members when the cylinders are extended or retracted.

16. A method as defined in claim 12, wherein the one or more torque transfer members comprise a tubular surrounding the riser and interconnecting the tensioning ring and a lower support frame, each of the tubular and the floating platform including a stop for mated engagement to transfer torque from the tensioning ring to the floating platform.

17. A method as defined in claim 16, wherein one of the tubular and the gimbal mechanism is provided with an elongate key, and the other of the tubular and the gimbal mechanism is provided with an elongate slot for accommodating the key, thereby providing the stop to transfer torque from the tubular to the floating platform.

* * * * *